US005313970A

United States Patent [19]

Hung

[11] Patent Number: 5,313,970

[45] Date of Patent: May 24, 1994

[54] AUTOMATICALLY SQUEEZABLE WATER COLLECTOR OF UMBRELLA

[76] Inventor: Mei-Yueh Hung, c/o Hung Hsing Patent Service Center, P.O. Box 55-1670, Taipei (104), Taiwan, Taiwan

[21] Appl. No.: 152,375

[22] Filed: Nov. 16, 1993

[51] Int. Cl.[5] ..... A45B 25/28

[52] U.S. Cl. ..... 135/15.1; 135/48

[58] Field of Search ..... 135/44, 48, 15.1

[56] References Cited

U.S. PATENT DOCUMENTS

| | | | |
|---|---|---|---|
| 288,889 | 11/1883 | Susman | 135/48 |
| 474,616 | 5/1892 | Tyson | 135/48 |
| 1,016,301 | 2/1912 | Sutlive | 135/48 |
| 2,170,236 | 8/1939 | DeLamater | 135/48 |
| 2,427,188 | 9/1947 | Bossart | 135/48 |
| 2,838,058 | 6/1958 | Foltis et al. | 135/48 |
| 5,161,560 | 11/1992 | Sheu | 135/48 X |

FOREIGN PATENT DOCUMENTS

| | | | |
|---|---|---|---|
| 218729 | 8/1957 | Australia | 135/48 |

*Primary Examiner*—Carl D. Friedman
*Assistant Examiner*—Lan C. Mai

[57] ABSTRACT

A water collector for umbrella includes: a catcher member having a plurality of resilient jaws radially secured to a central collar or a retainer fixed on a tip portion of the umbrella, an absorbent lining secured to an inner surface of the catcher member for absorbing rainwater or raindrops drained from a wet umbrella when retracted or closed, and a web member circumferentially disposed around an outer surface of the catcher member, whereby upon opening of an umbrella cloth as urged by the umbrella ribs and tensioning springs, the rainwater absorbed and held in the absorbent lining in the catcher member will be outwardly squeezed and stripped as the lining is pressed in between the opened umbrella cloth and the resilient jaws of the catcher member, thereby automatically squeezing and removing water from the umbrella as previously absorbed in the water collector of the umbrella.

7 Claims, 3 Drawing Sheets

AUTOMATICALLY SQUEEZABLE WATER COLLECTOR OF UMBRELLA

BACKGROUND OF THE INVENTION

A conventional drip cup may be provided to collect rainwater dripping down or drained from an umbrella cloth of a wet umbrella. Such a conventional drip cup is always connected with a telescopic umbrella cover comprised of a plurality of cylindrical elements having their diameters gradually decreased towards a tip portion of the umbrella, whereby upon extending of the plural cylindrical elements of the umbrella cover, a wet umbrella can then be shielded to prevent water dripping or contamination to the surroundings, and upon retraction of the umbrella cover, the umbrella may then be opened for its use. The telescopic mechanism of the conventional umbrella cover and drain cup is complex to possibly cause operation inconvenience and increase production cost accordingly. Meanwhile, once the rainwater is collected, the collecting cup should be operated to decant or discharge the accumulated water outwardly, increasing its inconvenience. If forgetting to discharge or remove the water from the cup or collector, the water may be accidentally spilled, drained or may flow outwardly to moisten or contaminate the surroundings, causing hygienic problem.

SUMMARY OF THE INVENTION

The object of the present invention is to provide a water collector for umbrella including: a catcher member having a plurality of resilient jaws radially secured to a central collar or a retainer fixed on a tip portion of the umbrella, an absorbent lining secured to an inner surface of the catcher member for absorbing rainwater or raindrops drained from a wet umbrella when retracted or closed, and a web member circumferentially disposed around an outer surface of the catcher member, whereby upon opening of an umbrella cloth as urged by the umbrella ribs and tensioning springs, the rainwater absorbed and held in the absorbent lining in the catcher member will be outwardly squeezed and stripped as the lining is pressed in between the opened umbrella cloth and the resilient jaws of the catcher member, thereby automatically squeezing and removing water from the umbrella as previously held in the water collector of the umbrella.

DETAILED DESCRIPTION

Figure 1:
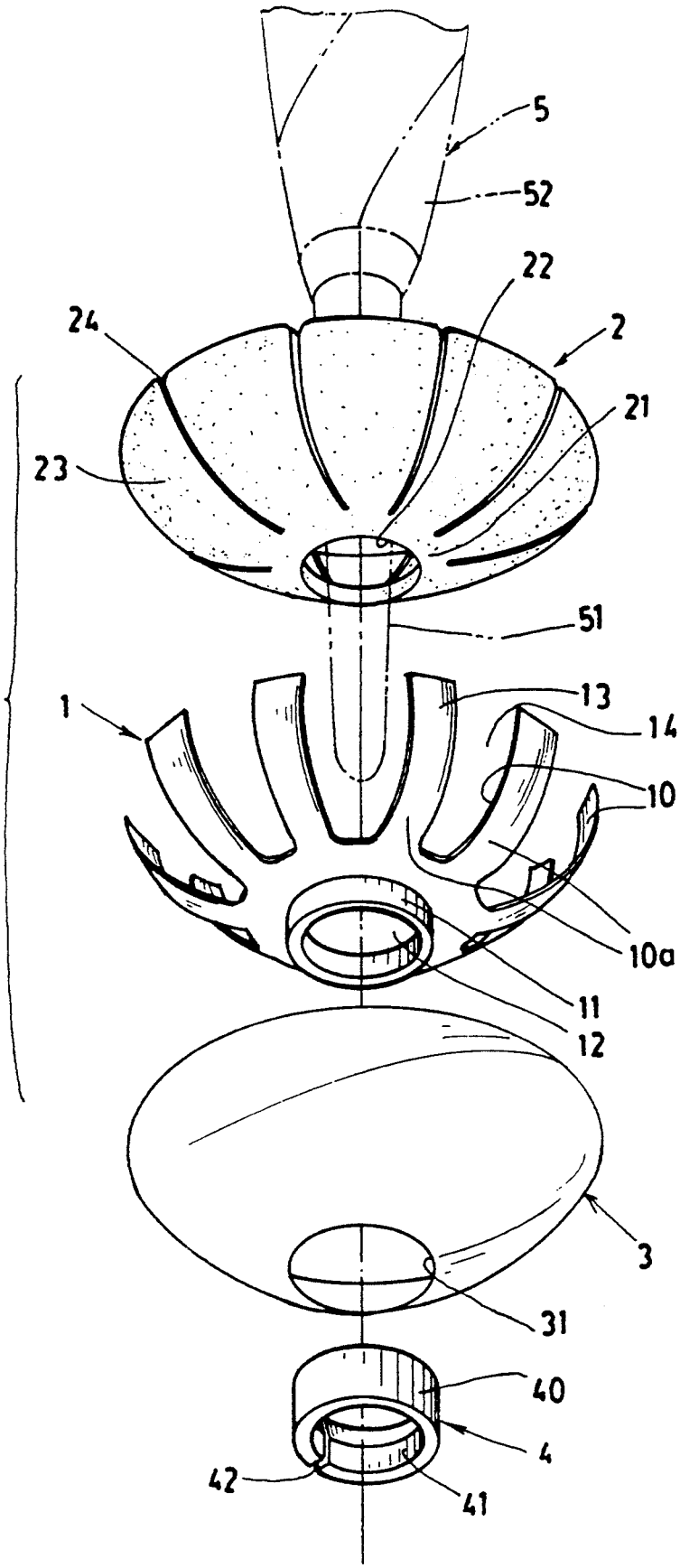
FIG. 1 is an exploded view showing the elements of the present invention.

As shown in the drawing figures, a water collector of the present invention comprises: a catcher member 1, an absorbent lining 2 secured on an inner surface 10 of the catcher member 1, a web member 3 secured on an outer surface 10*a* of the catcher member 1, and a retainer 4 fixed in a central portion of the catcher member 1 for securing the water collector on a tip portion 51 of the umbrella 5, especially on a joint portion 53 of the umbrella 5 between the tip portion 51 and an umbrella cloth 52.

Figure 4:
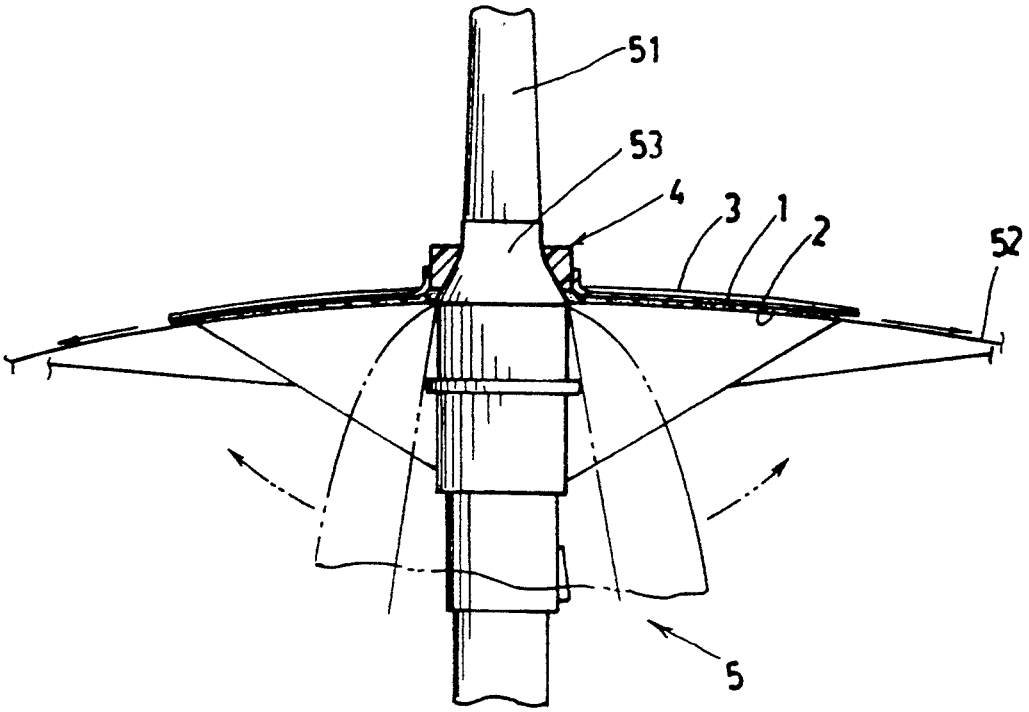
FIG. 4 shows a squeezing operation for removing rainwater absorbed in the water collector of the present invention when opening the umbrella.

The catcher member 1 is made of elastomer materials such as plastic materials having good elasticity and generally formed as conical, semi-spherical or cup-like shapes concave downwardly when mounted on an umbrella tip portion 51 facing downwardly, including: a collar portion 11 formed on a central portion of the catcher member 1, a central hole 12 formed through the collar portion 11 engageable with the retainer 4 secured to a joint portion 53 between the tip portion 51 and the umbrella cloth 52, a plurality of resilient jaws 13 radially protruding upwardly arcuately from the collar portion 11 to form a generally cup shape circumferentially disposed around the joint portion 53 adjacent to the tip portion 51 of the umbrella 5, and a plurality of radial slots 14 radially formed in the catcher member 1 each slot 14 separating every two neighbouring resilient jaws 13. Each resilient jaw 13 is bent upwardly arcuately to form a generally parabolic curve to produce its elasticity for resiliently clamping and squeezing the absorbent lining 2 as sandwiched in between the catcher member 1 and an opened umbrella cloth 53 as shown in FIG. 4 for squeezably draining rainwater previously absorbed in the absorbent lining 2.

The absorbent lining 2 may be made of flexible water-absorbing materials, such as: cotton, fabric, fibrous materials, sponge, foams or other absorbents carried on or impregnated in an absorbent medium, and includes: a central base portion 21 secured to a collar portion 11 of the catcher member 1, a central hole 22 formed through the absorbent lining 2 engageable with the joint portion 53 between the tip portion 51 and the umbrella cloth 52 for fastening the absorbent lining 2 on the joint portion 53 of the umbrella 5, a plurality of absorbing sectors 23 radially disposed around the central base portion 21 by radially cutting a plurality of radial slits 24 in the lining 2 each radial slit 24 separating every two neighbouring absorbing sectors 23, with all absorbing sectors 23 embedded, adhered or secured to an inner surface 10 of each resilient jaw 13 of the catcher member 1.

The web member 3 may be made of flexible thin-layer sheet, membrane or film elastomeric materials secured to an outer surface portion 10*a* of the catcher member 1 by adhering or securing an outer surface of each resilient jaw 13 of the catcher member 1 to an inner surface of the web member 3, having a central hole 31 formed in a central portion of the web member 3 engageable with the collar portion 11 of the catcher member 1 to be fixed on the tip portion 51 of the umbrella 5.

The web member 3 will serve to connect every two neighbouring resilient jaws 13 so as to provide a full "anvil" base to cooperatively squeeze a moistened absorbent lining 2 sandwiched between the opened umbrella cloth 53 and the catcher member 1 secured with the web member 3 which shields the radial slots 14 among the resilient jaws 13 of the catcher member 1. If eliminating such a web member 3, the catcher member 1 will reduce its total area, because of the area of the "void" slots 14, to decrease a water removing efficiency when squeezing the water absorbed in the lining 2 in cooperation with the opened umbrella cloth 53.

The web material 3 may be made of plastic materials such as polyethylene (PE), fabric material or any other suitable materials, not limited in this invention.

The retainer 4 includes: a cylindrical sleeve 40 having a central sleeve hole 41 engageable with a tip portion 51 of the umbrella 5 with the sleeve 40 engageable in the central hole 12 of the collar portion 11 of the catcher member 1 for securing the retainer 4 and the catcher member 1 on the tip portion 51 of the umbrella 5.

The cylindrical sleeve 40 of the retainer 4 is cut with a notch 42 in a cylindrical wall of the sleeve 40 for resiliently clamping the tip portion 51 of the umbrella 5.

The retainer 4 may also be integrally formed with the collar portion 11 of the catcher member 1 by plastic molding process.

The retainer 4 may be modified to be a fastener, a clip or any other clamping devices securable to the umbrella tip portion 51. Also the retainer 4 may be provided with an adjustable mechanism for snugly fastening each tip portion of different diameters of different models of umbrellas.

Figure 2:
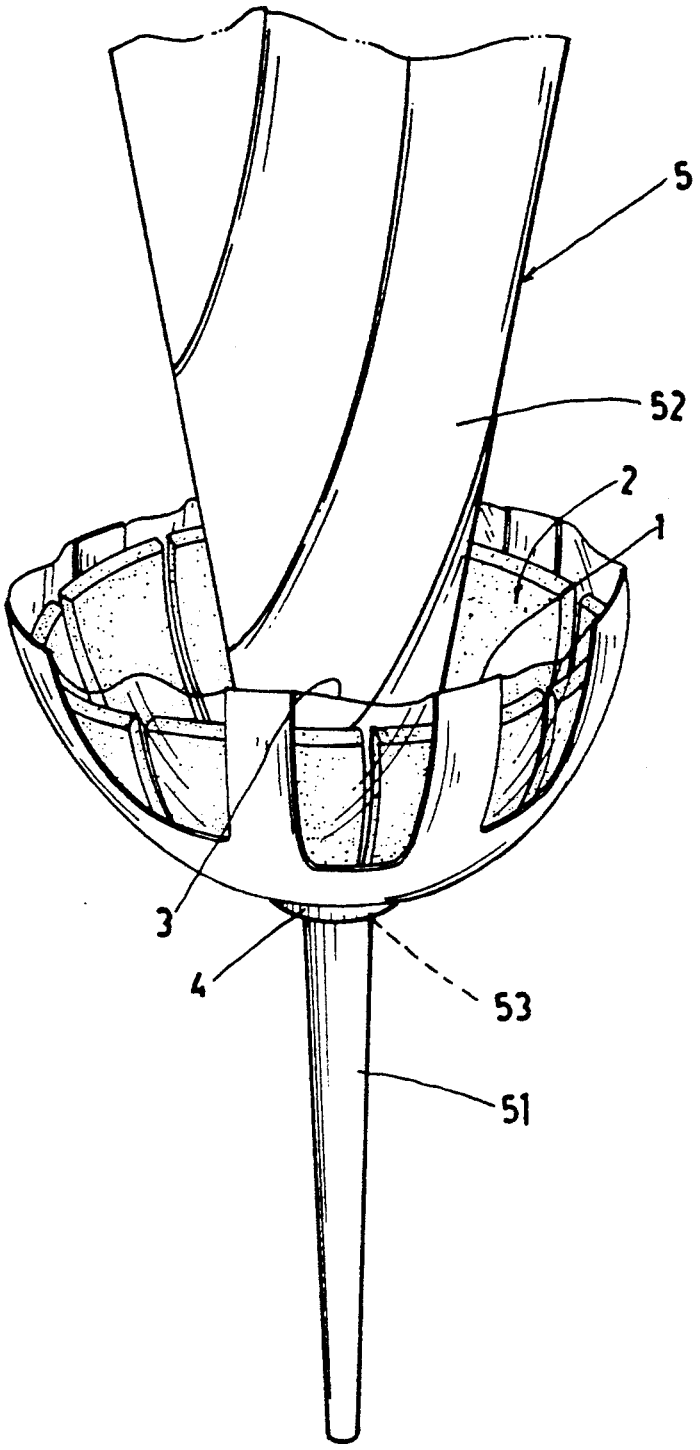
FIG. 2 is an illustration showing an assembled water collector of the present invention fixed on an umbrella tip portion for collecting rainwater from a wet umbrella cloth.
Figure 3:
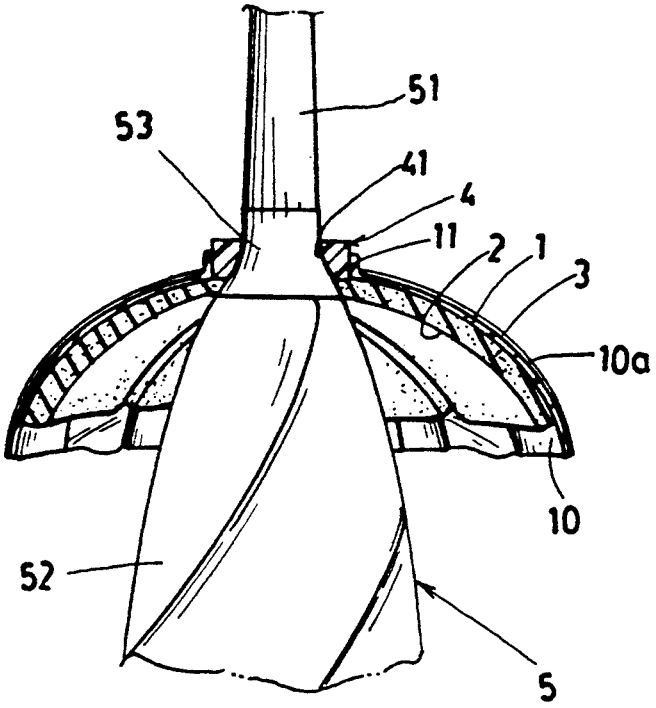
FIG. 3 shows an opened umbrella when inverted from FIG. 2 for shielding use.

When taking an umbrella of the present invention in a rainy day, a folded or retracted umbrella as shown in FIG. 2 by facing the tip portion 51 of the umbrella 5 downwardly towards a ground surface may drain the rainwater or drops gravitationally to the catcher member 1 to be absorbed in the absorbent lining 2 so as to prevent wetting or contamination to the others or the surroundings. Then, when re-using the umbrella of the present invention by opening a wet umbrella as shown in FIG. 4, the umbrella cloth 53 will be opened as urged by the tensioning springs provided on the umbrella shaft or ribs to squeeze the water previously absorbed in the lining 2 as sandwiched between the opened umbrella cloth 53 and the catchet member 1 to thereby remove the water from the water collector fixed on the umbrella. If the umbrella cloth is already saturated with much rainwater, the wet umbrella can be first rapidly shaken, thrown, casted, vibrated, or twisted to preliminarily shake off the water to reduce water quantity drained into the water collector of the present invention. This may prevent a saturation of water in the lining 2 of the present invention and thus prevent overflow of the water from the collector.

Whenever opening the umbrella of the present invention, the water previously absorbed in the water collector (lining 2) will be automatically squeezed and removed from the umbrella. Accordingly, this invention provides an umbrella which may automatically remove the collected rain water. Meanwhile, the water collector is simpler in construction, having compact volume and decreased production cost, to thereby be beneficial for its commercial uses.

The materials, shapes, sizes and arrangements of the elements in construction of this invention are not limited. Other modifications may be made without departing from the spirit and scope as claimed in this invention.

I claim:

1. A water collector of umbrella comprising:

a catcher member made of elastic materials and secured on a tip portion of an umbrella by a retainer fixed in a central portion of said catcher member;

an absorbent lining made of water-absorbing materials secured on an inner surface of said catcher member; and a flexible web member circumferentially disposed about and secured on an outer surface of said catcher member, whereby upon opening of a wet umbrella having rainwater previously drained and collected in said catcher member and absorbed by said absorbent lining, said absorbent lining with the rainwater absorbed therein will be squeezed and automatically removed as clamped and sandwiched in between an opened umbrella cloth as resiliently urged by a tensioning spring provided in the umbrella, and said catcher member secured with said flexible web member.

2. A water collector of umbrella according to claim 1, wherein said catcher member is made of elastomer materials having elasticity and concave downwardly when mounted on an umbrella tip portion facing downwardly, including: a collar portion formed on a central portion of the catcher member, a central hole formed through the collar portion engageable with the retainer secured to a joint portion between the tip portion and the umbrella cloth, a plurality of resilient jaws radially protruding upwardly arcuately from the collar portion to form a generally cup shape circumferentially disposed around the joint portion adjacent to the tip portion of the umbrella, and a plurality of radial slots radially formed in the catcher member each said slot separating every two neighbouring resilient jaws, each said resilient jaw bent upwardly arcuately to form a generally parabolic curve to produce an elasticity thereof for resiliently clamping and squeezing the absorbent lining as sandwiched in between the catcher member and an opened umbrella cloth for squeezably draining rainwater previously absorbed in the absorbent lining.

3. A water collector of umbrella according to claim 2, wherein said absorbent lining is made of flexible water-absorbing materials, and includes: a central base portion secured to a collar portion of the catcher member, a central hole formed through the absorbent lining engageable with the joint portion between the tip portion and the umbrella cloth for fastening the absorbent lining on the joint portion of the umbrella, a plurality of absorbing sectors radially disposed around the central base portion by radially cutting a plurality of radial slits in the lining, each said radial slit separating every two neighbouring absorbing sectors, with all said absorbing sectors secured to an inner surface of each said resilient jaw of the catcher member.

4. A water collector of umbrella according to claim 2, wherein said web member is made of flexible thin-layer elastomeric materials secured to an outer portion of the catcher member by securing each said resilient jaw of the catcher member to an inner surface of the web member, having a central hole formed in a central portion of the web member engageable with the collar portion of the catcher member to be fixed on the tip portion of the umbrella.

5. A water collector of umbrella according to claim 2, wherein said retainer includes: a cylindrical sleeve having a central sleeve hole engageable with a tip portion of the umbrella with the sleeve engageable in the central hole of the collar portion of the catcher member for securing the retainer and the catcher member on the tip portion of the umbrella.

6. A water collector of umbrella according to claim 5, wherein said cylindrical sleeve of the retainer is cut with a notch in a cylindrical wall of the sleeve for resiliently clamping the retainer on the tip portion of the umbrella.

7. A water collector of umbrella according to claim 5, wherein said retainer is integrally formed with the collar portion of the catcher member.

* * * * *